US009073616B1

(12) United States Patent
Wiegele et al.

(10) Patent No.: US 9,073,616 B1
(45) Date of Patent: Jul. 7, 2015

(54) MARINE ENGINE COWLING

(71) Applicant: BRP US INC., Sturtevant, WI (US)

(72) Inventors: Dale A. Wiegele, Kenosha, WI (US); Dave Calamia, Burlington, WI (US); George Broughton, Wadsworth, IL (US); Guillaume Longpre, Valcourt (CA); Jeff T. Turner, Beach Park, IL (US); John Charles Scott, Lake Villa, IL (US); Mark C. Noble, Pleasant Prairie, WI (US); Patrick C. Tetzlaff, Caledonia, WI (US); Philippe Petit, Orford (CA); Roger Raetzman, Pleasant Prairie, WI (US); Vincent Groleau, Sherbrooke (CA)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 14/230,438

(22) Filed: Mar. 31, 2014

Related U.S. Application Data

(63) Continuation of application No. 13/285,601, filed on Oct. 31, 2011, now abandoned.

(60) Provisional application No. 61/408,365, filed on Oct. 29, 2010.

(51) Int. Cl.
*B63H 20/32* (2006.01)
*B63H 20/14* (2006.01)

(52) U.S. Cl.
CPC ..... *B63H 20/32* (2013.01); *B63H 20/14* (2013.01)

(58) Field of Classification Search
USPC ..... 440/77
IPC ..... B63H 20/32
See application file for complete search history.

(56) References Cited

U.S. PATENT DOCUMENTS

| | | | |
|---|---|---|---|
| 2,549,485 | A | 4/1951 | Kiekhaefer et al. |
| 2,756,736 | A | 7/1956 | Kiekhaefer et al. |
| 3,358,668 | A | 12/1967 | Post et al. |
| 3,750,615 | A | 8/1973 | Haft et al. |
| 3,773,010 | A | 11/1973 | Elingsen |
| 3,955,526 | A | 5/1976 | Kusche |
| 4,348,194 | A | 9/1982 | Walsh |
| 4,379,702 | A | 4/1983 | Takeda et al. |
| 4,571,193 | A | 2/1986 | Takada et al. |
| 4,600,396 | A | 7/1986 | Crane et al. |
| 4,698,037 | A | 10/1987 | Watanabe et al. |
| 4,723,927 | A | 2/1988 | Walsh et al. |
| 4,860,703 | A | 8/1989 | Boda et al. |
| 4,867,120 | A | 9/1989 | Boda et al. |
| 4,869,693 | A | 9/1989 | Curtis et al. |
| 4,952,180 | A | 8/1990 | Watanabe et al. |

(Continued)

*Primary Examiner* — Stephen Avila
(74) *Attorney, Agent, or Firm* — BCF LLP

(57) ABSTRACT

A marine outboard engine includes an engine having a front, back, top and two lateral sides. A cowling, covering the engine at least partially, includes a central support structure fixedly connected to at least one of the engine, a swivel bracket, and an exhaust system. The central support structure extending across at least a portion of the front, top and back of the engine defines at least partially a space through which at least a portion of at least one of its lateral sides is accessible. The space is selectively covered by at least one side panel which is at least partially selectively connected to the central support structure and at least partially disconnectable therefrom to reveal the portion of the at least one of the lateral sides of the engine while the central support structure extends across at least the portion of the front, top and back thereof.

20 Claims, 14 Drawing Sheets

(56) References Cited

U.S. PATENT DOCUMENTS

| | | | |
|---|---|---|---|
| 4,968,276 | A | 11/1990 | Hashimoto |
| 5,025,763 | A | 6/1991 | Watanabe |
| 5,052,960 | A | 10/1991 | Kato |
| 5,052,961 | A | 10/1991 | Uchida et al. |
| 5,328,395 | A | 7/1994 | Oishi |
| 5,407,372 | A | 4/1995 | Mondek et al. |
| 5,472,361 | A | 12/1995 | Fujimoto et al. |
| 5,487,687 | A | 1/1996 | Idzikowski et al. |
| 5,489,227 | A | 2/1996 | Ishida et al. |
| 5,803,777 | A | 9/1998 | Hiraoka |
| 5,873,755 | A | 2/1999 | Takahashi et al. |
| 5,938,491 | A | 8/1999 | Kawai et al. |
| 6,017,254 | A | 1/2000 | Katayama et al. |
| 6,048,236 | A | 4/2000 | Natsume |
| 6,074,258 | A | 6/2000 | Arai et al. |
| 6,099,371 | A | 8/2000 | Nozawa et al. |
| 6,106,342 | A | 8/2000 | Kameoka |
| 6,132,273 | A | 10/2000 | Nakayama et al. |
| 6,227,921 | B1 | 5/2001 | Feehan |
| 6,287,161 | B1 | 9/2001 | Nozawa |
| 6,302,749 | B1 | 10/2001 | Tawa et al. |
| 6,390,865 | B1 | 5/2002 | Kameoka |
| 6,439,938 | B1 | 8/2002 | Katayama |
| 6,488,552 | B2 | 12/2002 | Kitsu et al. |
| 6,663,450 | B1 | 12/2003 | Walczak et al. |
| 6,669,517 | B1 | 12/2003 | Alby et al. |
| 6,682,379 | B1 | 1/2004 | Walczak et al. |
| 6,821,170 | B2 | 11/2004 | Sanschagrin et al. |
| 6,846,211 | B2 | 1/2005 | Yasuda et al. |
| 6,875,066 | B2 | 4/2005 | Wolaver |
| 6,878,022 | B2 | 4/2005 | Yasuda et al. |
| 6,910,929 | B2 | 6/2005 | Yasuda et al. |
| 6,991,500 | B1 | 1/2006 | Gulko et al. |
| 7,044,098 | B2 | 5/2006 | Amano et al. |
| 7,118,432 | B2 | 10/2006 | Katayama |
| 7,140,933 | B2 | 11/2006 | Nakamura et al. |
| 7,163,428 | B2 | 1/2007 | Sanschagrin |
| 7,210,973 | B2 | 5/2007 | Sanschagrin et al. |
| 7,217,166 | B2 | 5/2007 | Fukuoka et al. |
| 7,247,064 | B2 | 7/2007 | Nakamura |
| 7,249,985 | B2 | 7/2007 | Fukuoka et al. |
| 7,320,630 | B2 | 1/2008 | Nakamura |
| 7,364,485 | B2 | 4/2008 | Kameoka |
| 7,401,598 | B2 | 7/2008 | Ochiai |
| 7,425,163 | B2 | 9/2008 | Murai et al. |
| 7,455,560 | B2 | 11/2008 | Arai et al. |
| 7,540,794 | B2 | 6/2009 | Inoue et al. |
| 7,621,791 | B2 | 11/2009 | Yazaki et al. |
| 2006/0172631 | A1 | 8/2006 | Kameoka |
| 2006/0258235 | A1 | 11/2006 | Kimura et al. |
| 2008/0023923 | A1 | 1/2008 | Kameyama et al. |
| 2009/0318038 | A1 | 12/2009 | Hasegawa et al. |
| 2010/0147257 | A1 | 6/2010 | Yazaki et al. |

MARINE ENGINE COWLING

CROSS-REFERENCE

The present application is a continuation of U.S. patent application Ser. No. 13/285,601 filed on Oct. 31, 2011, which claims priority to U.S. Provisional Application No. 61/408,365 filed Oct. 29, 2010, the entirety of both of which is incorporated herein by reference.

TECHNICAL FIELD

The present invention relates to cowlings for marine engines.

BACKGROUND

A marine outboard engine includes a cowling which covers the engine and other internal components so as to prevent them from being damaged by water and other exterior elements. The cowling is usually divided into two parts. A top bell shaped portion covers the engine compartment and a column shaped bottom portion covers the driveshaft and other components located between the engine and the gear case.

As seen in FIGS. 1A and 1B, a prior art cowling 100PA of a prior art outboard marine engine 40PA includes an upper motor cover 110PA, a lower motor cover 111PA, and a cap 120PA defined in the upper motor cover 110PA. The cap 120 PA covers an access to an engine sub-system. The upper motor cover 110PA encloses a top portion of an engine 44PA. The upper motor cover 110PA is a generally half-spherical unitary plastic piece. The lower motor cover 111PA surrounds the remainder of the engine 44PA not covered by the upper motor cover 110PA and an exhaust system 46PA. A connection between the upper motor cover 110PA and the lower motor cover 111PA extends from a front to a back of the outboard marine engine 40PA. A lower edge 70PA of the upper motor cover 110PA mates in a sealing relationship with an upper edge 72PA of the lower motor cover 111PA. A seal 74PA is disposed between the lower edge 70PA of the upper motor cover 110PA and the upper edge 72PA of the lower motor cover 111PA to form a watertight connection. A locking mechanism 76PA is provided on a right side of the cowling 100PA. When a user desires to do maintenance on the engine 44PA, the user detaches the upper motor cover 110PA from the lower motor cover 111PA using the locking mechanism 76PA, and then removes the whole upper motor cover 110PA.

The marine outboard engine 40PA includes several engine sub-systems or engine accessories (not shown) directly connected to the engine 44PA. The engine sub-systems control an operation of the engine 44PA. The engine sub-systems can include, but are not limited to: an ECU, at least one ignition coil, an electrical wire harness and a fuse box, an induction system, a flywheel magneto, a starter motor, an alternator, a fuel evaporator separator, an exhaust manifold, a fuel injector, an oil pump, an oil reservoir, and a secondary fuel reservoir.

As viewed from behind in FIG. 1B, the marine outboard engine 40PA, the cowling 100PA has a general rounded top contour defined by the upper motor cover 110PA and an angular and sudden transition to a tubular shape bottom contour defined by the lower motor cover 111PA. The upper motor cover 110PA and the lower motor cover 111PA have a generally horizontal partition.

There are several inconveniences with the prior art cowlings for marine outboard engines. First, because the cowlings are disposed around the engine, they are designed to accommodate the most outwardly extending parts of the engine. As a consequence, the cowlings are often more voluminous than required. Second, in order to access a specific part of the engine, the user has to remove heavy and voluminous parts of the cowling. Third, the cowling, which is usually shipped with the engine, is prone to scratching during transportation or during handling, and become unsatisfactory to the user. Fourth, a cowling can represent manufacturing and shipping challenges. Also, the marine outboard engine assembly is dependent on the cowling since the cowling is assembled last. Finally, prior art cowlings provide the user with limited customizing options.

Therefore, there is a need for a cowling for a marine engine that would allow to access different parts of the engine without removing large cowling pieces.

There is also a need for a cowling for a marine engine that would be easy to transport and to manufacture.

Finally, there is a need for a cowling for a marine engine that would ease an assembly of a marine outboard engine.

SUMMARY

It is an object to ameliorate at least some of the inconveniences present in the prior art.

It is an object of the present invention to provide a cowling having a central support structure fixed to at least one of the engine, the swivel bracket and the exhaust system of the marine outboard engine, so that the central support structure does not have to be removed for performing routine maintenance and operation of the engine.

It is also an object to provide a method for assembling a marine engine.

It is yet another object to provide a method for removing a marine outboard engine from a watercraft.

In one aspect, a marine outboard engine includes an engine having a front, back, top and two lateral sides. One of a propeller and an impeller is operatively connected to the engine. A swivel bracket is operatively connected to the engine. An exhaust system is connected to the engine. A cowling covers the engine at least partially. The cowling includes a central support structure fixedly connected to at least one of the engine, the swivel bracket, and the exhaust system. The central support structure extends across at least a portion of the front, the top and the back of the engine. The central support structure defines at least partially a space through which at least a portion of at least one of the lateral sides of the engine is accessible. At least one side panel is at least partially selectively connected to the central support structure. The at least one side panel selectively covers the space through which the at least portion of the at least one of the lateral sides of the engine is accessible. The at least one side panel is at least partially disconnectable from the central support structure to reveal the portion of the at least one of the lateral sides of the engine while the central support structure extends across at least the portion of the front, the top and the back of the engine.

In an additional aspect, a portion of the central support structure located behind the engine extends vertically below the engine.

In a further aspect, the at least one side panel covers at least a portion of the central support structure.

In a further aspect, the central support structure includes two structural panels fixedly connected to each other along a vertical axis of the marine outboard engine. Each of the two structural panels extending at least partially across the top and a respective one of the lateral sides of the engine.

In an additional aspect, the central support structure includes a central structural panel extending at least partially across the top of the engine and two lateral structural panels attached on either side thereof. Each lateral structural panel extends at least partially across a respective one of the lateral sides of the engine. At least one of the lateral structure panels defines at least partially the space through which the at least portion of the at least one of the lateral sides of the engine is accessible. The at least one side panel is at least partially selectively connected to a corresponding at least one of the two lateral structural panels defining at least partially the space through which the at least portion of the one of the lateral sides of the engine is accessible.

In a further aspect, the central structural panel comprises a top portion extending generally horizontally across at least a portion of the top of the engine, and a front portion extending generally vertically across at least a portion of the front of the engine.

In an additional aspect, the space defined at least partially by the central support structure includes a lateral side aperture of the central support structure disposed on each of the lateral sides of the engine. A portion of each of the lateral sides of the engine is accessible though a corresponding one of the lateral side apertures of the central support structure. The at least one side panel includes two side panels at least partially selectively connected to the central support structure. Each of the two side panels selectively covers a respective one of the two lateral side apertures.

In an additional aspect, the central support structure is elongated along a vertical axis of the marine outboard engine.

In a further aspect, a portion of the engine protrudes through the space defined at least partially by the central support structure. As viewed from behind the marine outboard engine, the at least one side panel protrudes outwardly relative to the central support structure.

In an additional aspect, at least one engine sub-system is supported by an interior of at least one of the central support structure and the at least one side panel.

In an additional aspect, the at least one engine sub-system includes at least one of a fuse box, an ECU, an electrical wire harness and at least one ignition coil.

In a further aspect, the at least one side panel is at least partially selectively connected to the central support structure by at least one of a hinge, a clip and a friction fit connection to the central support structure.

In an additional aspect, a cap at least partially selectively connected to a top of the central support structure. The cap selectively covers a servicing area of the engine.

In an additional aspect, the servicing area provides an access to one of an attachment point of the engine and a flywheel that is operatively connected to a top of the engine.

In a further aspect, the central support structure includes at least one truss. The at least one side panel forms an outer surface of the cowling.

In an additional aspect, a driveshaft is operatively connected to the engine and to the one of the propeller and the impeller. As viewed from a lateral side of the marine outboard engine with the driveshaft being vertically upright, the cowling extends from a top of the engine to a point vertically below a middle of the swivel bracket. As viewed from behind the marine outboard engine, at least one of the central support structure and the at least one side panel has a convex contour and the cowling has a generally ovoid shaped contour.

In a further aspect, the at least one side panel extends from at least a top of the engine to at least a lowest point of the swivel bracket.

In an additional aspect, the at least one side panel extends from at least the top of the engine to at least a lowest point of the swivel bracket.

In a further aspect, at least one engine sub-system is provided. The lateral sides of the engine are a left and a right lateral side. The two lateral structural panels are a left and a right structural panel. The left structural panel extends at least partially across the left lateral side of the engine. The right structural panel extends at least partially across the right lateral side of the engine. The space defined at least partially by the central support structure includes at least one left side aperture in the left structural panel and at least one right side aperture in the right structural panel. The at least one left and right side apertures are disposed on respective left and right lateral sides of the engine. A portion of the left and right lateral sides of the engine is accessible through the corresponding at least one left and right side apertures of the central support structure. The at least one side panel includes at least one left side panel and at least one right side panel. The at least one left side panel selectively covers the at least one left side aperture. The at least one right side panel selectively covers the at least one right side aperture. The at least one engine sub-system is selectively accessible through at least one of the at least one left and right side apertures.

In another aspect, a method for assembling a marine outboard engine is provided. The marine outboard engine has an engine and a cowling adapted to at least partially cover the engine. The cowling includes a central support structure adapted to extend across at least a portion of a front, a top and a back of the engine, and at least one side panel. At least one engine sub-system of the engine is connected to an interior of the cowling. The central support structure is fixedly connected to at least one of the engine, a swivel bracket of the marine outboard engine and an exhaust system of the marine outboard engine. The at least one side panel is connected over a lateral side aperture defined by the central support structure so as to selectively cover the lateral side aperture. The at least one side panel is at least partially disconnectable so as to at least partially uncover the lateral side aperture while the central support structure extends across at least the portion of the front, the top and the back of the engine.

In a further aspect, the step of connecting the at least one engine sub-system of the engine to an interior of the cowling includes connecting the at least one engine sub-system to the central support structure.

For purposes of this application, terms related to spatial orientation such as forwardly, rearwardly, upwardly, downwardly, left, and right, are as they would normally be understood by a driver operating a watercraft in a normal riding position, the watercraft having the marine outboard engine mounted on a transom thereof.

Embodiments of the present invention each have at least one of the above-mentioned object and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

The description will refer to marine cowlings for a marine outboard engine. However, it is contemplated that some aspects of the cowlings could be adapted for use on a marine inboard engine.

Figure 1A:
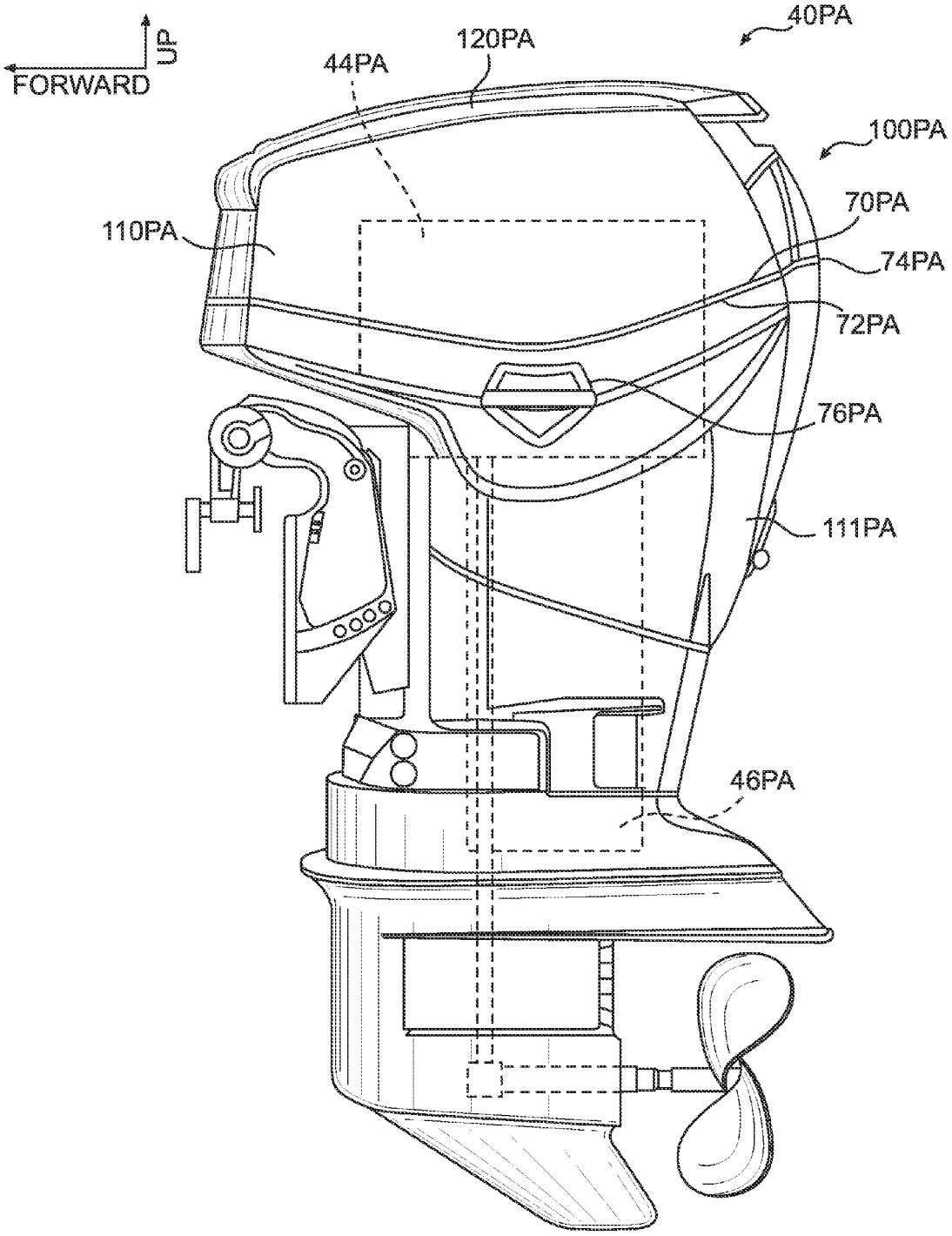
FIG. 1A (PRIOR ART)
FIG. 1A is a left side elevation view of a prior art marine outboard engine.
Figure 1B:
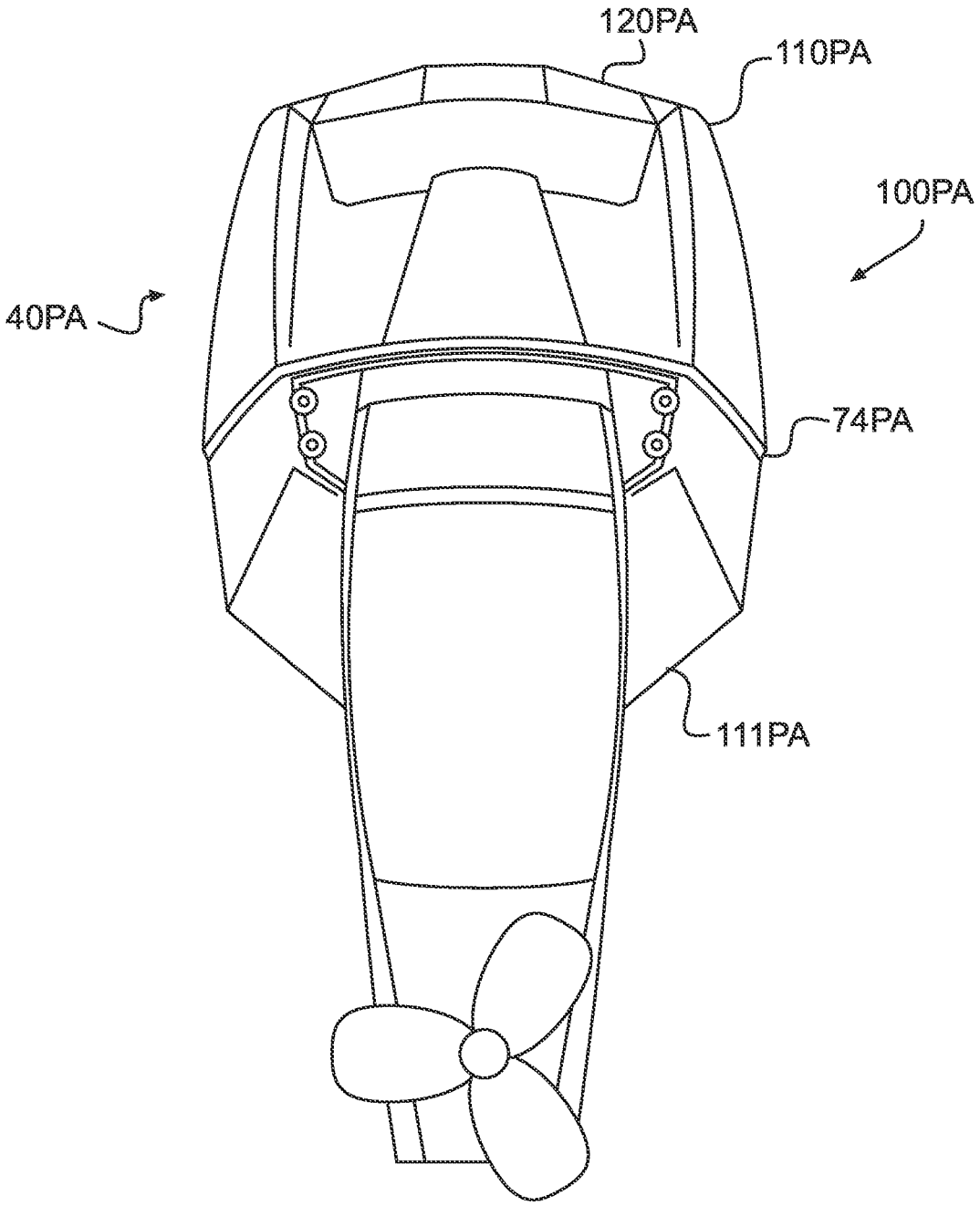
FIG. 1B (PRIOR ART)
FIG. 1B is a rear elevation view of the prior art marine outboard engine of FIG. 1A.
Figure 2:
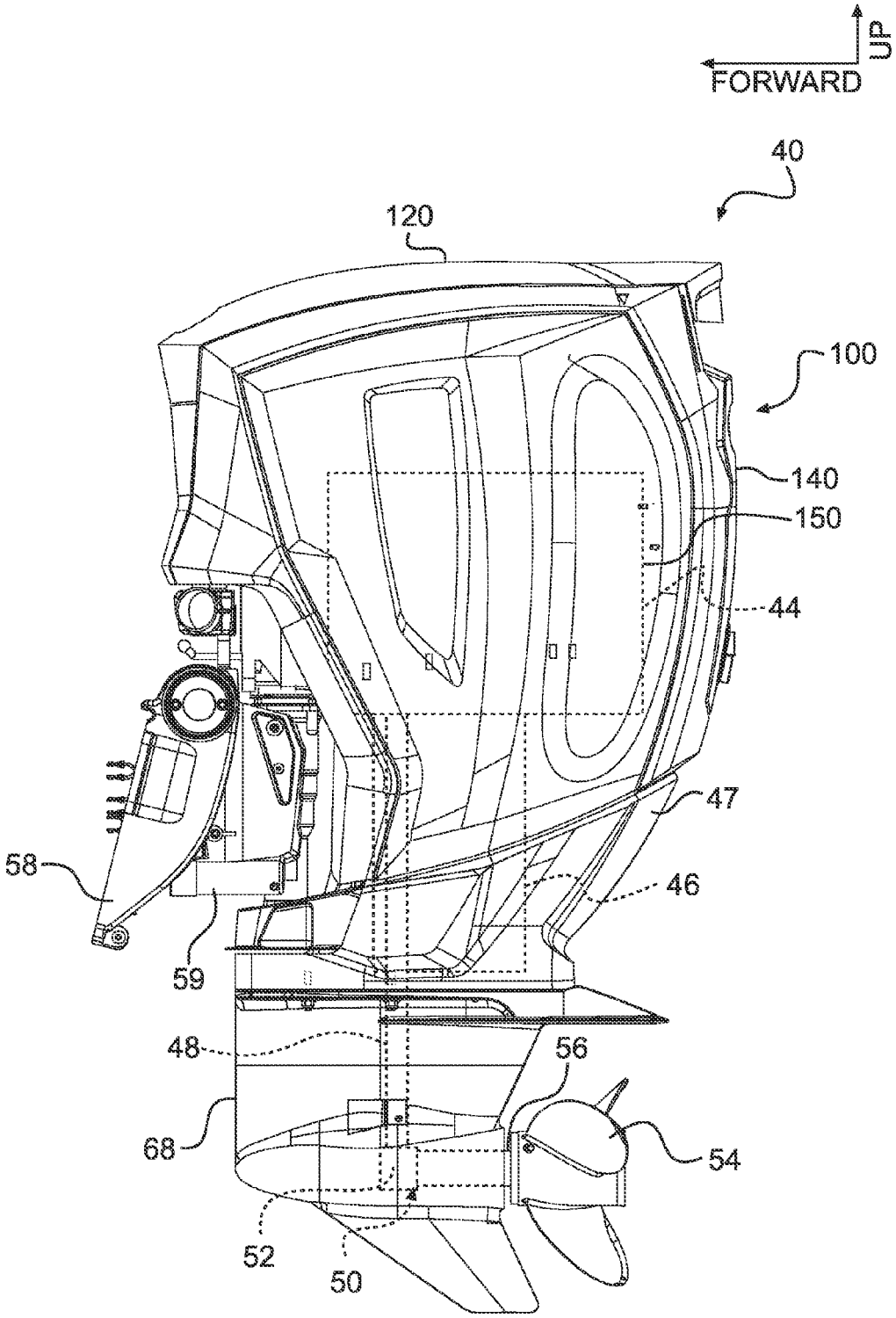
FIG. 2 is a left side elevation view of a marine outboard engine.
Figure 3:
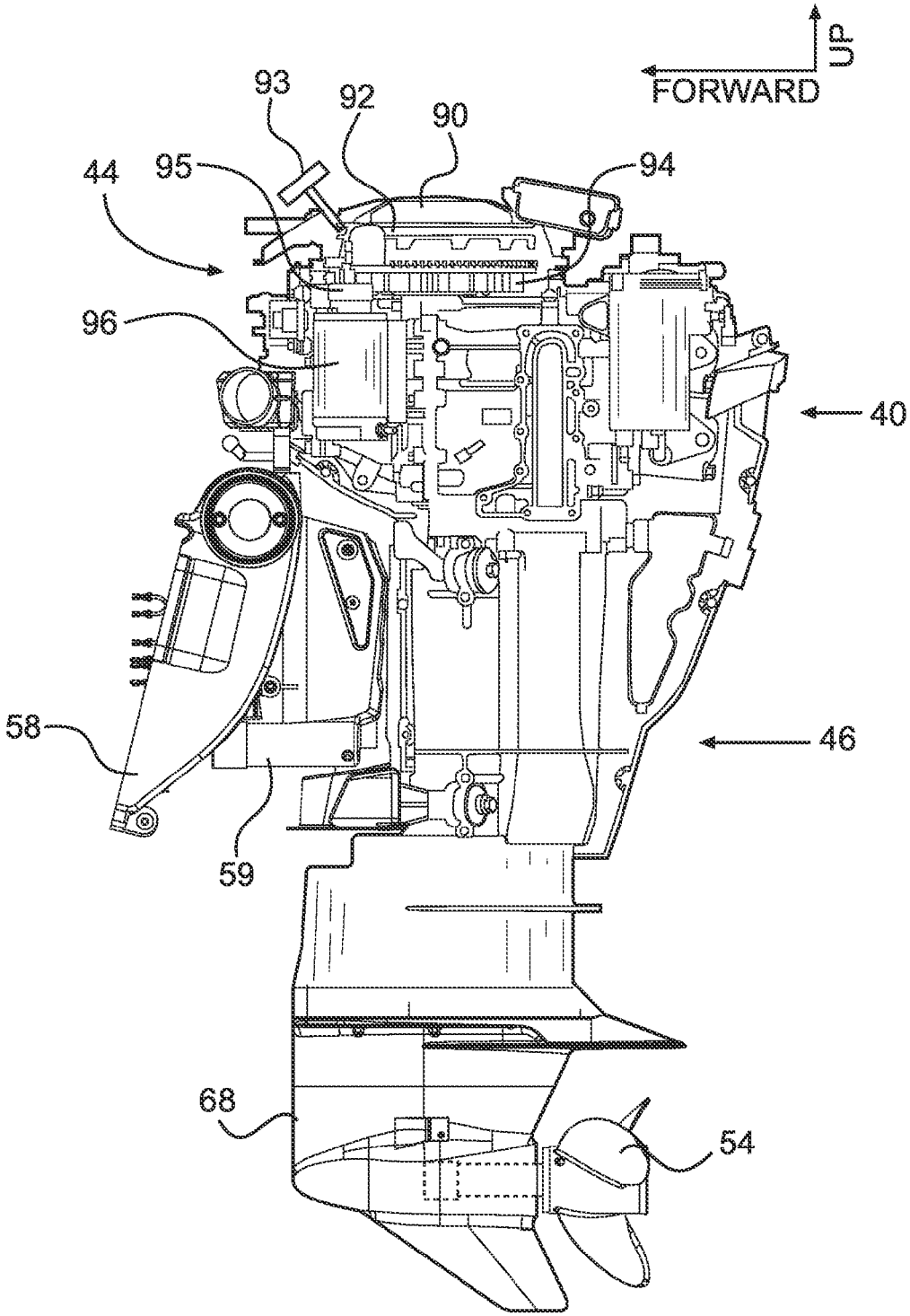
FIG. 3 is a left side elevation view of the marine outboard engine of FIG. 2 with the cowling removed to reveal an engine of the marine outboard engine.
Figure 4:
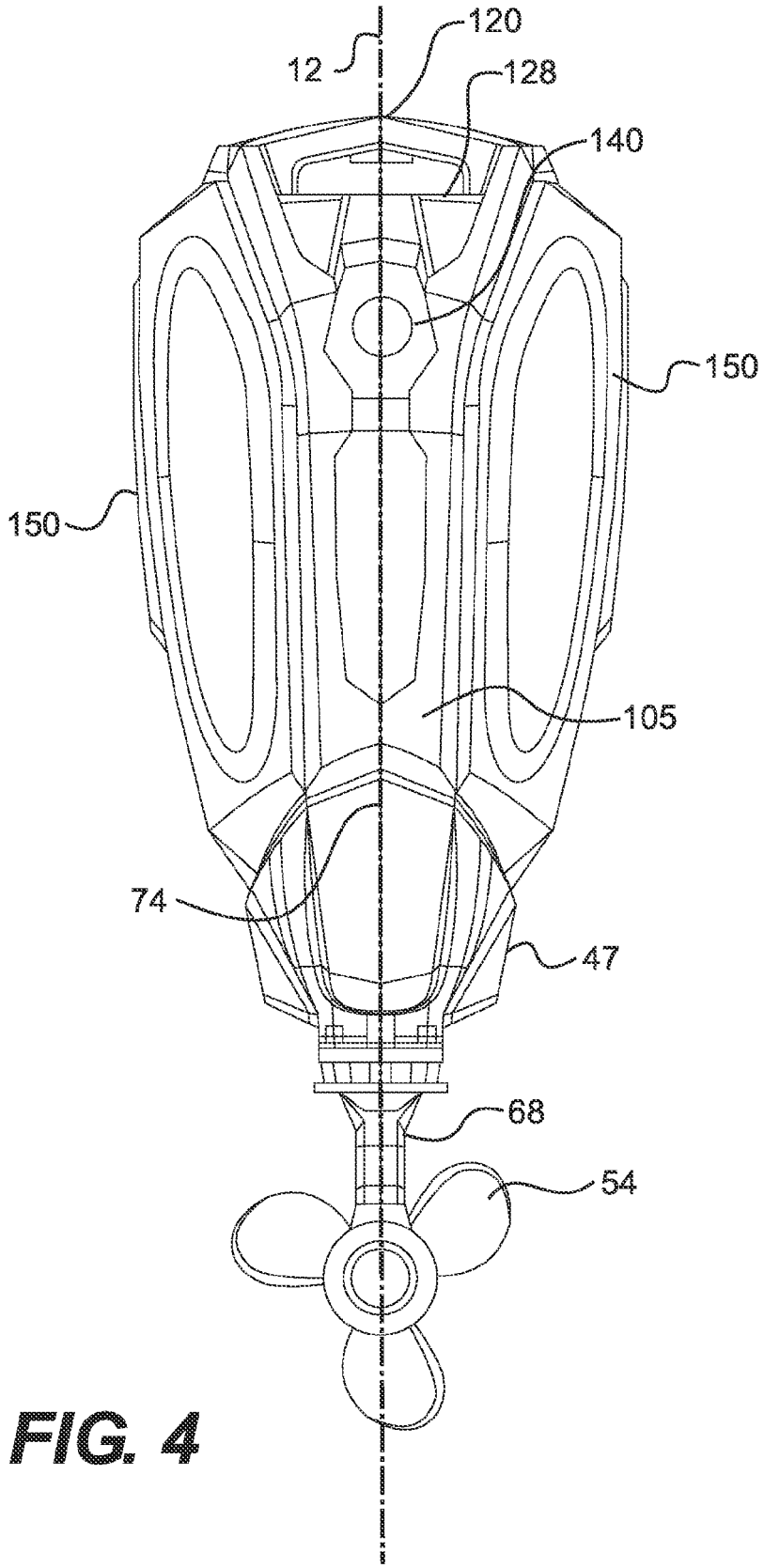
FIG. 4 is a rear elevation view of the marine outboard engine of FIG. 2.

Referring to FIGS. 2 to 4, a marine outboard engine 40 has a cowling 100 protecting an engine 44 (shown schematically). The engine 44 is a V-type, six cylinders internal combustion engine. It is contemplated that other types of engine 44 could be used. An exhaust system 46 (shown schematically), including an exhaust housing 47, is connected to the engine 44. An adaptor (not shown) can also be provided between the engine 44 and the exhaust housing 47. The exhaust system 46 is partially surrounded by the cowling 100. The engine 44 is coupled to a vertically oriented driveshaft 48 (shown schematically). The driveshaft 48 is coupled to a drive mechanism 50 (shown schematically), which includes a transmission 52 (shown schematically) and a bladed rotor, such as a propeller 54 mounted on a propeller shaft 56. The propeller shaft 56 is generally perpendicular to the driveshaft 48, but could be at other angles. The drive mechanism 50 could also include a jet propulsion device, turbine or other known propelling device. The bladed rotor could also be an impeller. A stern bracket 58 is connected to the cowling 100 via the swivel bracket 59 for mounting the marine outboard engine 40 to a watercraft. The stern bracket 58 can take various forms, the details of which are conventionally known. The swivel bracket 59 partly houses a steering shaft (not shown) of the marine outboard engine 40.

Referring more specifically to FIG. 3, a flywheel/alternator 90 is located on a top of the engine 44. The flywheel/alternator 90 is connected directly to the crankshaft (not shown) of the engine 44. The flywheel/alternator 90 also acts as a pull-start system and includes a pulling rope 92 connected to the flywheel/alternator 90 at one end, which is wound around the flywheel/alternator 90 and a handle 93 provided at the other end of the rope 92 to enable the user to pull on the rope 92 to crank and start the engine 44 manually. The flywheel portion 94 of the flywheel/alternator 90 has a toothed outside circumference such that it acts like a large gear and can be engaged by the pinion gear 95 of the starter motor 96 located directly below the flywheel portion 94 of the flywheel/alternator 90. In operation, when a solenoid (not shown) of the starter motor 96 is activated by an electric current, the pinion gear 95 extends to engage the flywheel portion 94 of the flywheel/alternator 90 and rotates the flywheel/alternator 90 to crank and start the outboard engine 40.

Referring once again to FIGS. 2 and 4, a general appearance of the cowling 100 will be described. The cowling 100 extends from the top of the engine 44 to a point vertically below a middle of the swivel bracket 59 when the driveshaft 48 is vertically upright, as shown, which is about a gear case 68 of the marine outboard engine 40. As from behind the marine outboard engine 40, the cowling 100 has a generally ovoid shaped contour, with a top larger than a bottom. It can be noticed that the generally ovoid shaped contour differs from the general rounded top contour and tubular shape bottom contour of the cowling 100PA. Also, as viewed from behind the marine outboard engine 40, a contour of the cowling 100 is generally convex and does not feature the angular and sudden transition of the cowling 100PA. Given the generally ovoid shaped contour aligned with a vertical axis 12, the cowling 100 has a generally tall and slender look. It is contemplated that the cowling 100 could extend above or below the point vertically below the middle of the swivel bracket 59.

The marine outboard engine 40 has other features, well known in the art, which will not be described herein.

Referring to FIGS. 5 to 8, different parts of a first embodiment of the cowling 100 will be described.

The design of the cowling 100 revolves around a panel construction. A central support structure 105 is fixedly connected to the engine 44 and several panels 120, 130, 140, 150 are removably connected to the central support structure 105. By 'fixedly connected', one should understand that the central support structure 105 is a semi-permanent structure. While it is possible to disconnect the central support structure 105 from the outboard engine 40 for specific purposes as described below, during routine use of the cowling 100 the central support structure 105 stays fixed to the outboard engine 40. In this first embodiment, the central support structure 105 includes left (or port) and right (or starboard) structural panels 110, which will be described in further detail below. The central support structure 105 supports the panels 120, 130, 140, 150 and connects them to the engine 44. The panels 120, 130, 140, 150 form an outer surface of the cowling 100. An assembly of the panels 120, 130, 140, 150 and the central supporting structure 105 form the cowling 100. Because the panels 120, 130, 140, 150 are removable from the central support structure 105, the panels 120, 130, 140, 150 can be shipped separately from the central support structure 105 and the engine 44. As will be described below, the panels 120, 130, 140, 150 enclose or otherwise cover, and therefore when removed provide access to different parts of the engine 44. It is contemplated that the central support structure 105 could (instead or in addition) be fixed to the swivel bracket 59 and/or the exhaust system 46. It is contemplated that the cowling 100 could comprise more or less than the panels 120, 130, 140, 150, and that some could not be external panels of the cowling 100. It is contemplated that the central support structure 105 could be entirely covered by the panels 120, 130, 140, 150. For example, the central support structure 105 could be one or more beams or trusses which extend across and at least partially surround the engine 44 without covering it, and external panels could connect to the beams such that they cover both the engine 44 and the beams or trusses. It is also contemplated that some or all of the panels 120, 130, 140, 150 could themselves support other panels. It is contemplated that some or all of the panels 120, 130, 140, 150 could not be removable from central support structure 105, but be only partially selectively connected to the central support structure 105, by for example being hinged.

The panels 120, 130, 140 and 150 will now be described. The panels 120, 130, 140 and 150 include a cap 120, a front cover 130, a rear seam (or back) cover 140 and left and right (or lateral) side panels 150. It is contemplated that the cowling 100 could have more or less than the above recited panels. The panels 120, 130, 140 and 150 are removably connected to an exterior 107 (shown in FIG. 6) of the central support structure 105.

Because the structure of the cowling 100 involves removable (or at least partially selectively connected) panels providing accesses to the engine 44, it is not required to remove the central support structure 105 for performing regular maintenance on the engine 44. The user can perform regular maintenance of the engine 44 through conveniently located spaces 114, 121 and 123 formed in the central support structure 105 which provide access to specific parts of the engine 44 (e.g. spark plugs and injectors). These spaces 114, 121 and 123 are formed at least in part by the central support structure 105. In this first embodiment, the spaces 114, 121 and 123 are lateral side apertures 114 and top apertures 121, 123 which are delineated by edges of the panels 110 which form the central support structure 105. It is also contemplated that the spaces 114, 121 and 123 could not be fully delineated by edges formed by the central support structure 105. The central support structure 105 may be removed when performing specific operations on the engine 44 when maintenance or repairs cannot be performed using the apertures 114, 121, 123. To access a specific part of the engine 44, the user temporarily removes or opens one of the panels 120 or 150 covers the aperture 114, 121, or 123 corresponding to that part of the engine 44 that the user wishes to access. It is contemplated that the front and back of the central support structure 105 could have apertures to access the engine 44, and that the panels 130, 140 or other panels would provide selective access to these apertures. It is contemplated that more or less of the apertures 114, 121, 123 could provide access to the engine 44.

The central support structure 105 will now be described in greater detail. The central left and right structural panels 110 are made of plastic. It is contemplated that the structural panels 110 could be made of metal or of composite material. Although the central support structure 105 is shown in the Figures as being made of structural panels 110, it is contemplated that the central support structure 105 could be different from the structural panels 110. For example, the central support structure 105 could be made of one or more trusses adapted to support the panels 120, 130, 140, 150, or a combination of trusses and panels. In one example, an external surface of the truss is an external surface of the cowling 100. In another example, the central support structure 105 is a single elongated plate extending along the back or a portion of the back of the engine 44. In another example, the central support structure 105 is an assembly of rods or plates. It is contemplated that the left and right structural panels 110 could be a unique panel or that the central support structure 105 could be made of more than two structural panels 110. For example, the unique panel could have one or more live hinges to allow the unique panel to be disposed around the engine 44 when assembling or disassembling the cowling 100. It is also contemplated that the left and right structural panels 110 could not extend across the front or the top or a portion of the sides of the engine 44. For example, the left and right structural panels 110 could extend across only a portion of the front or a portion of the top or the portion of the sides of the engine 44.

Each of the structural panels 110 extend across the top of the engine 44 and extend from the top of the engine 44 to a point below the engine 44 about a point vertically below the middle of the swivel bracket 59. The structural panels 110 extend across a portion of the lateral sides of the engine 44. In the embodiment described herein, the structural panels 110 extend across the top of the engine 44 and the portion of the lateral sides of the engine 44. It is contemplated that, like in the case where the structural panels 110 are trusses, the structural panels 110 could extend across only a portion the top of the engine 44 and a portion of the portion of the lateral sides of the engine 44. A bottom of the central support structure 105 is open, and connects to the exhaust system 46. It is contemplated that the bottom of the central support structure 105 could connect to the gear case 68. It is contemplated that the central support structure 105 could extend across only a portion of the top of the engine 44 or could extend from a lateral side of the engine 44 to the upper part of the gear case 68. It is contemplated that the central support structure 105 could extend from a lateral side of the engine 44 to the top of the engine 44.

The central support structure 105 is elongated along the vertical axis 12 (shown in FIG. 4). The left and right structural panels 110 are connected to each other along a vertical sealing line 74. The left and right structural panels 110 are bolted to each other at connection points 112 (shown in FIG. 8) along back, top, front and a portion of sides of the engine 44, so that the central support structure 105 extends across portions of the front, the top and the back of the engine 44. It is also contemplated that the structural panels 110 could be secured fixedly to each other, other than by bolts. It is contemplated that a seal could be disposed at the vertical sealing line 74. The structural panels 110 (as shown for the right structural panel 110 in FIG. 8) have reinforcements 152 on their interior 106. It is contemplated that the structural panels 110 could have no reinforcement 152.

Each of the left and right structural panels 110 of the central support structure 105 has one of the lateral side apertures 114. The portions of the engine 44 revealed by the lateral side apertures 114 are selectively covered by side panels 150. It is contemplated that the left and right structural panels 110 could each have none or more than one lateral side aperture 114 and that more than one side panel 150 could cover these lateral side apertures 114. It is also contemplated that the structural panels 110 (and hence the central support structure 105) could have dents or recesses instead or in addition to the lateral side aperture 114. It is also contemplated that the portions of the engine 44 revealed by the lateral side apertures 114 could protrude laterally outwardly from the lateral side aperture 114 with the side panels 150 selectively covering them.

Figure 5:
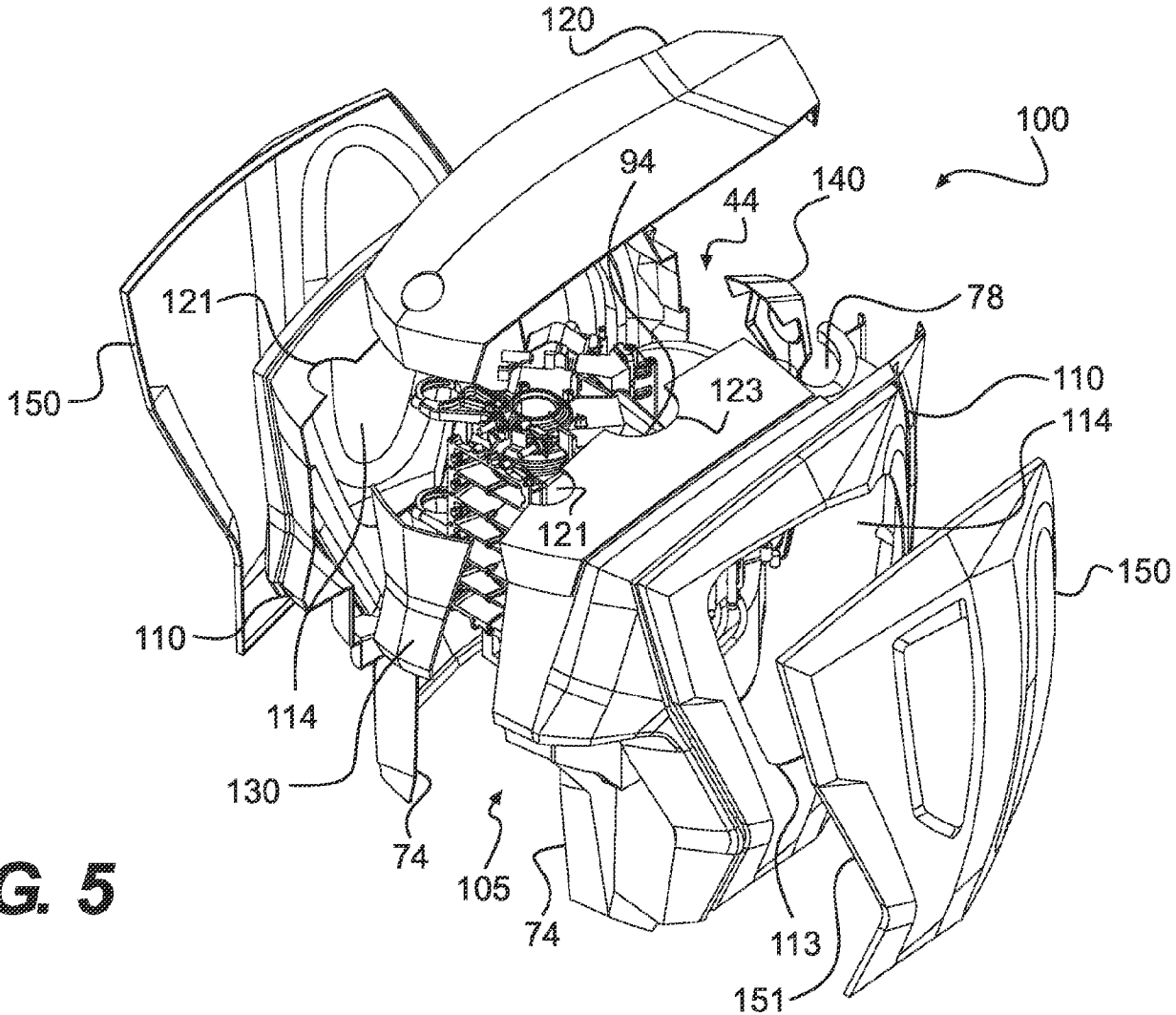
FIG. 5 is a perspective exploded view taken from a top, front, left side of a cowling according to a first embodiment and a portion of the engine of the marine outboard engine of FIG. 2.

As best seen in FIG. 5, the front cover 130 connects to a portion of the front of the central support structure 105. The front cover 130 covers a portion of the vertical sealing line 74 and therefore provides an additional barrier to water and external elements. It is contemplated that a seal could be disposed between the front cover 130 and the central support structure 105. Similarly, the back cover 140 connects to a portion of a back side of the central support structure 105 so as to provide an additional barrier to water and external elements. It is contemplated that a seal could be disposed between the back cover 140 and the central support structure 105. The front cover 130 and the back cover 140 are clipped to the central support structure 105. It is contemplated that the front cover 130 and the back cover 140 could be connected to the central support structure 105 other than by clipping. For example, the front cover 130 and the back cover 140 could be hinged or friction fitted to the central support structure 105. The front cover 130 and the back cover 140 are made of a same plastic as the central support structure 105. It is contemplated that the front cover 130 and the back cover 140 could be made of a different plastic. It is also contemplated that the front cover 130 and the back cover 140 could be made of a material other than plastic.

Figure 6:
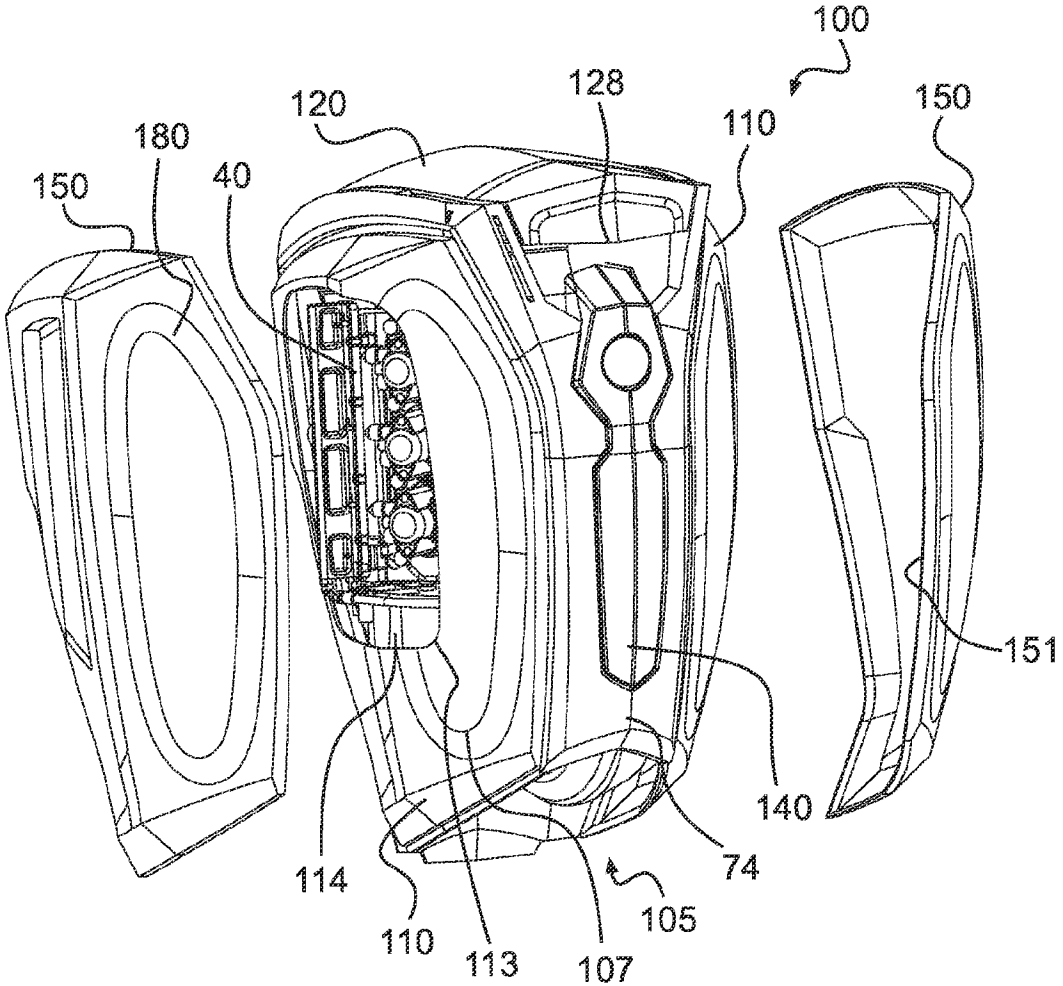
FIG. 6 is a perspective view taken from a bottom, rear, left side of a cowling and the engine of the marine outboard engine of FIG. 2 with side panels disconnected from a central support structure.

As best seen in FIGS. 5 and 6, the side panels 150 are each a single moulded piece of a same plastic as the central support structure 105. It is contemplated that the side panels 150 could be made of a material other than the one of the central support structure 105 and other than a plastic.

The side panels 150 are removably connected to the central support structure 105, which is to say that they can be attached and detached. In contrast with the left and right structural panels 110 which form the central support structure 105, the side panels 150 are intended to be removable by the user. The side panels 150 are friction fitted. It is contemplated that one or more snap features could be used to friction fit the side panels 150. For each side panel 150, the user uses a gripping area 151 integrated in a contour of the side panels 150 to grip the side panel 150 and remove it from the central support structure 105. The gripping area 151 can also be used when connecting the side panel 150 to the central support structure 105. The gripping area 151 shown in the Figures runs around the side panels 150, but it is contemplated that the gripping area 151 could be located at only one portion of the side panels 150. For example, the gripping area 151 could be a handle. It is also contemplated that the gripping area 151 could be in a middle of the side panels 150 rather than on a contour of the side panel 150. It is also contemplated that more than one gripping area 151 could be used. It is also contemplated that the side panels 150 could be hinged and/or clipped to the central support structure 105 instead of or in additional to being friction fitted to the central support structure 105. It is also contemplated that the side panels 150 could be locked to the central support structure 105 via a locking mechanism.

A water tight connection between the structural panels 110 of the central support structure 105 and the side panels 150 is ensured by seals 180 (shown in FIG. 6). One seal 180 is disposed on each side panel 150. The seal 180 is adapted to contact with at a rim 113 of the lateral side aperture 114. It is contemplated that the water tight connection could be at a location other than the rim 113 of the lateral side aperture 114. It is also contemplated that the seal 180 could be on the rim 113 of the lateral side aperture 114 instead of on the side panel 150. It is also contemplated that the water tight connection could be achieved differently. It is also contemplated that more than one seal 180 could be used.

As best seen in FIG. 5, each of the left and right side panels 150 is larger than their corresponding lateral side aperture 114. Because of this, the left and right side panels 150 cover a portion of their corresponding left and right structural panels 110 and provide an additional barrier to potential water leaking in the cowling 100. It is contemplated that the side panels 150 could be of the size of their corresponding lateral side aperture 114.

The side panels 150 extend from a top of their corresponding structural panels 110 to a bottom of their corresponding structural panels 110. As viewed from a lateral side, the side panels 150 are slightly narrower than the structural panels 110. As a consequence, the central support structure 105 protrudes rearwardly relative to the two side panels 150. It is contemplated that the central support structure 105 could be as wide as or narrower than the two side panels 150. The side panels 150 are slightly curved outwardly to accommodate a shape of the engine 44 and the central support structure 105. It is contemplated that the side panel 150 could have a shape different from the one shown in the Figures. For example, the side panels 150 could be curved so as to accommodate portions of the engine 44 protruding through the lateral side apertures 114. Unlike those shown in the Figures, it is contemplated that the left and right side panels 150 could be different from each other. A shape of the side panels 150, their fit with the central support structure 105 and seams lines that are extending generally vertically contribute to the overall tall and slender look to the cowling 100. Since the side panels 150 are removable, it is possible to replace the side panels 150 as desired.

Figure 7:
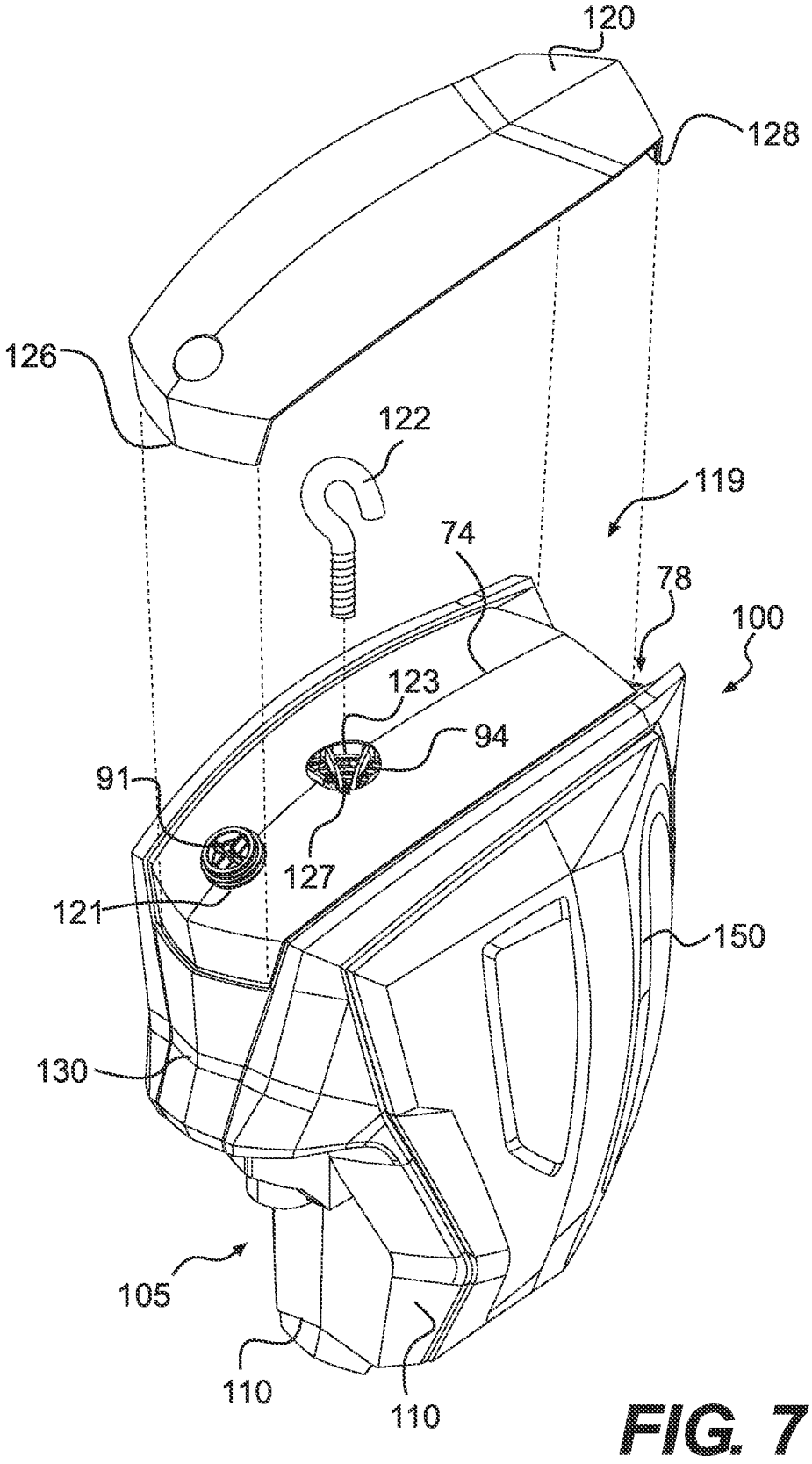
FIG. 7 is a perspective view taken from top, front, left side of the cowling and the engine of the marine outboard engine of FIG. 2 with a top panel disconnected from the central support structure.

As best seen in FIG. 7, the cap 120 is clipped to a top of the central support structure 105. The cap 120 is made of a same plastic as the central support structure 105. The cap 120 provides access to a servicing area 119 of the outboard engine 40. It is contemplated that only a portion of the cap 120 could provide access to the servicing area 119. It is contemplated that the cap 120 could be made of a plastic other than the one of the central support structure 105. It is also contemplated that the cap 120 could be made of a material other than plastic. For example, the cap 120 could be made of a flexible material. The servicing area 119 will be described below.

The cap 120 is an elongated panel extending from the front of the central support structure 105 to the back of the central support structure 105. The cap 120 has front and back flanges. Gripping areas 126, 128 at the front and back flanges of the cap 120 are used to clip and unclip the cap 120 to the central support structure 105. It is contemplated that the cap 120 could not extend at the front of the central support structure 105 and/or at the back of the central support structure 105. It is also contemplated that the cap 120 could have only one or none of the front and back flanges. It is contemplated that a seal could be disposed between the cap 120 and the central support structure 105. It is contemplated that the cap 120 could be connected to the central support structure 105 other than by clipping. For example, the cap 120 could be hinged to the central support structure 105. It is contemplated that one or more latches could be provided to connect the cap 120 to the central support structure 105.

The servicing area 119 has the top aperture 121 for accessing an oil filler neck 91 and the top aperture 123 for accessing the flywheel 94. The cap 120 also covers an air intake 78 (shown in FIG. 4) of the engine 44. The flywheel 94 gives access to a hooking area 127 where a threaded end (not shown) of an output shaft (not shown) of the engine 44. A hook 122 can be screwed when the user desires to remove the marine outboard engine 40 from the watercraft, as described below. It is contemplated that the hook 122 could be already connected to the output shaft. It is contemplated that the threaded aperture could be at an end of the crankshaft of the engine 44. A method for removing the marine outboard engine 40 using the hook 122 and an access through the cap 120 will be described below.

It is contemplated that the servicing area 119 could comprise a tool compartment. For example, a recess in the servicing area 119 could accommodate some or all of a screwdriver, a rope, a light and a wrench. It is also contemplated that the servicing area 119 could have less or more than the apertures described above. For example, the servicing area 119 could have an aperture for a starter rope of the engine 44 and an oil dip stick.

Figure 8:
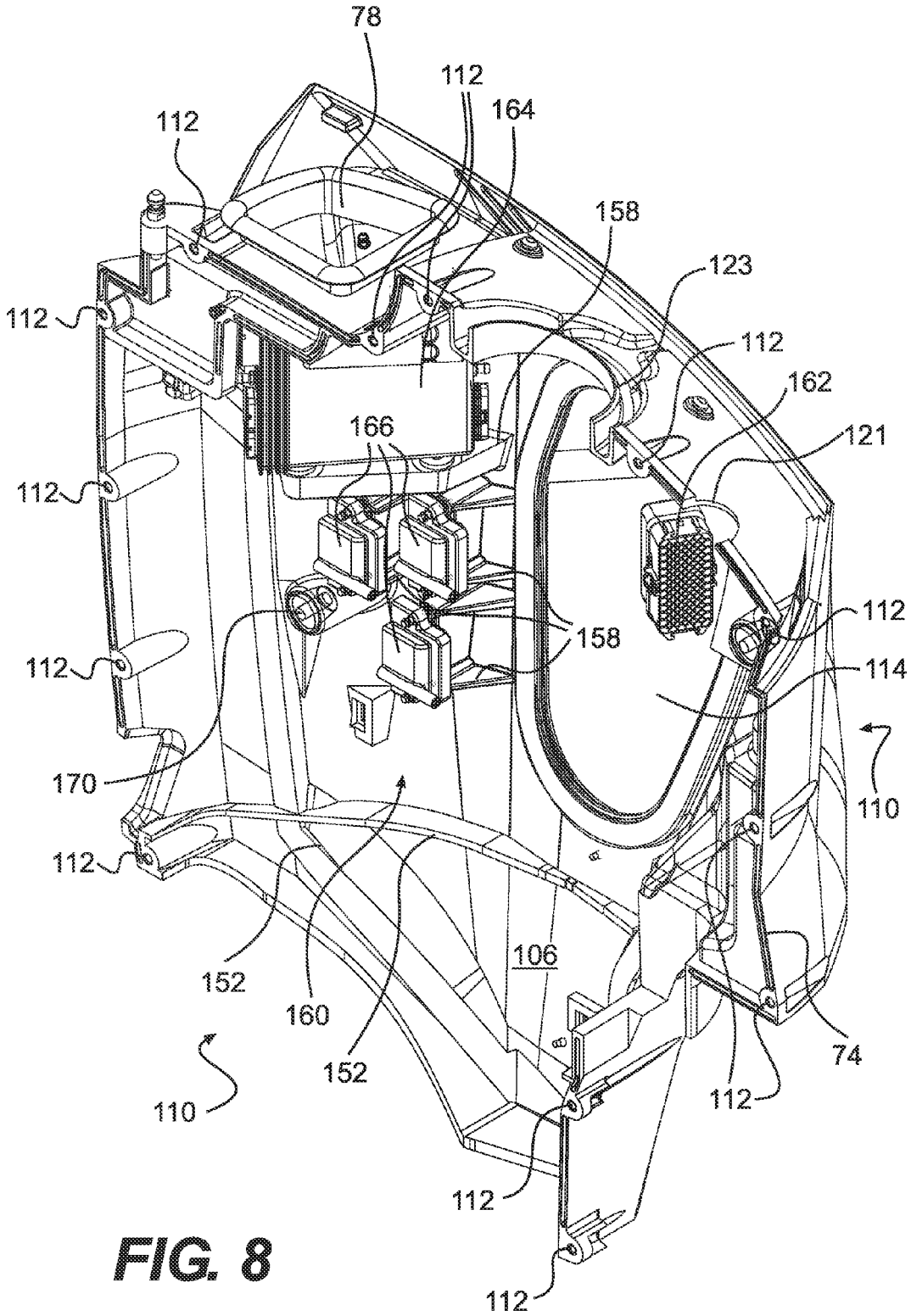
FIG. 8 is a perspective view taken from a top, front, right side of an interior of a left side panel of the central support structure of the cowling of FIG. 2.

Referring now to FIG. 8, the interior 106 of the central support structure 105 will be described. Although the interior 106 of the left structural panel 110 is described, it is contemplated that the interior 106 of the right structural panel 110 is similar but not necessary the same.

The interior 106 of the central support structure 105 supports several engine sub-systems 160 of the engine 44. The engine sub-systems 160 are electric systems that are used for the operation of the engine 44. The engine sub-systems 160 supported by the right structural panel 110 are a fuse box 162, an ECU 164, an electrical wire harness (not shown) and three ignition coils 166. It is contemplated that the engine sub-systems 160 could have more or less of the engine sub-systems 160 recited above. It is also contemplated that the engine sub-systems 160 could be electronic or mechanical. For example, the engine sub-systems 160 could be an oil reservoir, a water pump, a valve, an induction system, a fuel evaporator separator, an oil pump, or a secondary fuel reservoir. It is also contemplated that some or all of the engine sub-systems 160 could be supported by the left structural panel 110. It is contemplated that only the left or only the right structural panel 110 could support the engine sub-systems 160. It is contemplated that some or all of the sub-systems 160 could be supported by the side panels 150. It is also contemplated that less or more than three ignition coils 166 could be used. It is contemplated that the engine sub-systems 160 could not be connected to the interior 106 of the central support structure 105. For example, where the central support structure 105 is a truss, the engine sub-systems 160 could be connected onto the central support structure 105. In another example, the engine sub-systems 160 are disposed between the central support structure 105 and the side panels 150.

The engine sub-systems 160 are spaced from the engine 44 and are therefore not abutting the engine 44. As a consequence, the engine sub-systems 160 are subject to less heat or vibration of the engine 44 than if they were connected directly to the engine 44, as it is the case in the prior art marine outboard engine 40PA. Rubber mounts 170 are connecting the interior 106 of the central support structure 105 and the engine 44, and provide some additional vibration isolation. It is contemplated that the rubber mounts 170 could be omitted. It is also contemplated that the rubber mounts 170 could be mounted between the central support structure 105 and at least one of the engine 44, the swivel bracket 59 and the exhaust system 46.

Brackets 158, integrally formed with the interior 106 of the structural panels 110 of the central support structure 105, secure the engine sub-systems 160 to the central support structure 105. The engine sub-systems 160 are removably connected to the brackets 158. To secure or remove the engine sub-systems 160 to or from the central support structure 105, the user clips or unclips the engine sub-systems 160 to the brackets 158. During assembly of the marine outboard engine 40, as will be described below, the engine sub-systems 160 can be connected to the cowling 100 before assembly of the cowling 100 to the engine 44. It is contemplated that the engine sub-systems 160 could be connected to the brackets 158 by means other than clipping. For example, the engine sub-systems 160 could be bolted to the brackets 158. It is contemplated that the brackets 158 could not be integrally formed with the central support structure 105. It is also contemplated that rubber mounts or other isolation means could be connected to the brackets 158 so as to further isolate the engine sub-systems 160 from the engine 44 vibrations.

The engine sub-systems 160 are located proximate to the lateral side aperture 114 of the left structural panel 110. This proximity thus allows the user to perform maintenance or replacement of the engine sub-systems 160 by accessing them directly through the aperture 114 without removing the central support structure 105 from the engine 44.

Figure 9:
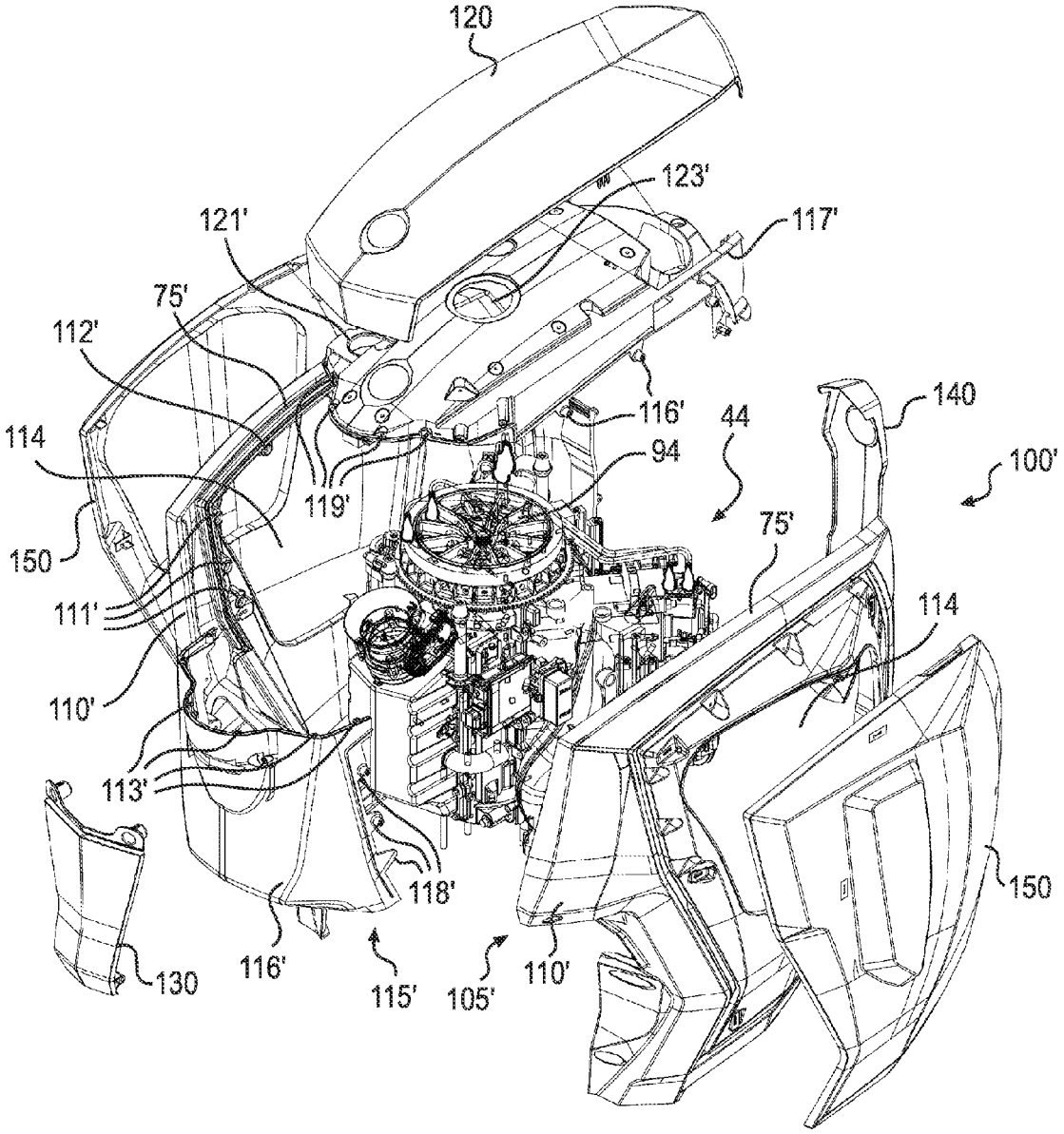
FIG. 9 is a perspective exploded view taken from a top, front, left side of a cowling according to a second embodiment and a portion of the engine of the marine outboard engine of FIG. 2.
Figure 10:
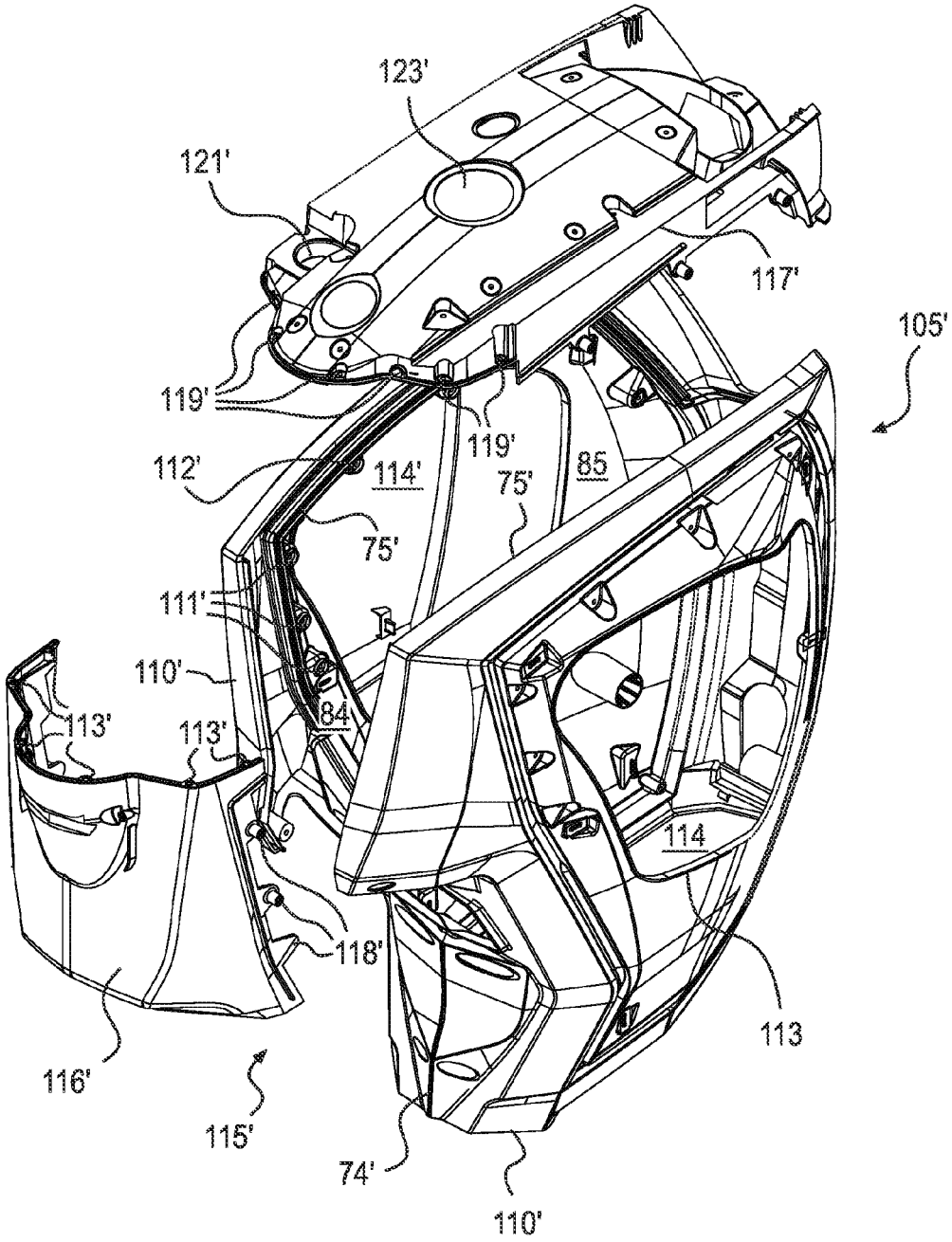
FIG. 10 is a partially exploded perspective view taken from a top, front, left side of a central support structure of the cowling of FIG. 9 shown with lateral structural panels connected to each other.
Figure 11:
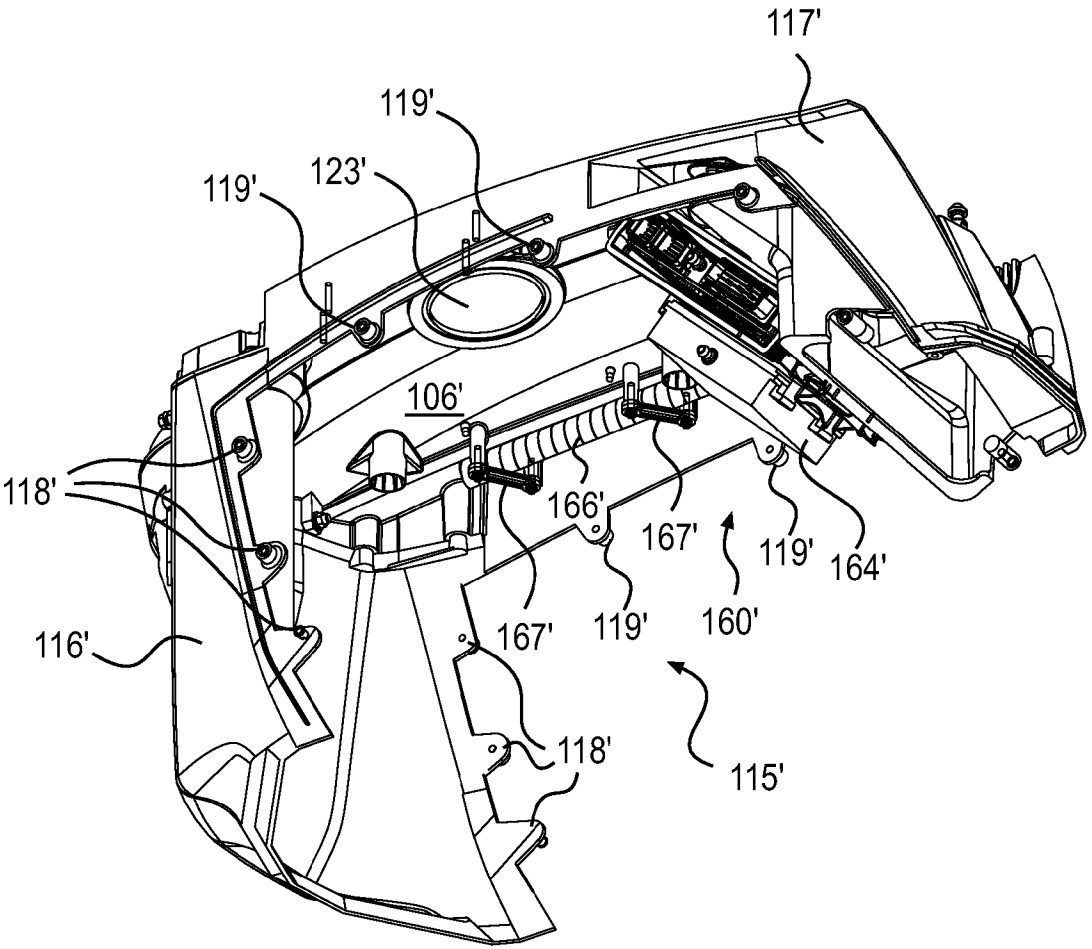
FIG. 11 is a perspective view taken from a bottom, rear, left side of a central structural panel of the cowling of FIG. 9.

Referring to FIGS. 9 to 11, a second embodiment of the cowling 100' will be described. Elements common to both the cowling 100' and the cowling 100 have been provided with the same reference numerals and will not be described in detail again.

In the cowling 100', a central support structure 105' is fixed to the engine 44. The panels 120, 130, 140, 150 are removably connected to the central support structure 105' in a manner similar to what has been described above with respect to the cowling 100. The central support structure 105' includes left and right structural panels 110' and a central structural panel 115'. The central structural panel 115' comprises a top portion 117' and a front portion 116', although it is contemplated that the panel 115' could alternatively be moulded as a single piece. The central support structure 105' is a semi-permanent structure, and may be removed from the engine 44 when performing specific operations on the engine 44.

Referring more specifically to FIG. 10, the left and right structural panels 110' of the central support structure 105' are similar to the structural panels 110 of the cowling 100 except that they do not form the servicing area 119 or the front surface beneath the front panel 130 when connected to each other. A space 84 is defined in front of the front portion 116' of the central structural panel 115' and between two forwardly extending portions of the left and right structural panels 110'. This space 84 is further enclosed by the front panel 130. The space 84 provides access to rigging connections (not shown). It is contemplated that the front portion 116' could be omitted and that the structural panels 110' could connect to each other at a front edge thereof similarly to the structural panels 110. Also, when connected to each other, the structural panels 110' define a space 85 at a top thereof. The space 85 provides access to a portion of the engine 44. The space 85 is covered by the top portion 117'. It is contemplated that the top portion 117' could be omitted and that the structural panels 110' could connect to each other at a top thereof similarly to the structural panels 110. The structural panels 110' connect to the engine 44 in a same way as the structural panels 110. Also, a connection of the back cover 140 to the structural panels 110' is similar to what has been described above for the structural panels 110.

With additional reference to FIG. 11, the top portion 117' and the front portion 116' are removably connected to each other by fasteners (not shown). The front portion 116' has connection points 113' to connect with connection points 119' of the top portion 117'. It is contemplated that the top portion 117' and the front portion 116' could be connected to each other by means other than the fasteners. It is contemplated that the top portion 117' and the front portion 116' could form a single structural panel. It is also contemplated that the central structural panel 115' could include more or less panels than the top portion 117' and the front portion 116'. The top portion 117' and the front portion 116' are made of the same material as the structural panels 110'. It is contemplated that the top portion 117' and the front portion 116' could be made of materials different from the one of the structural panels 110'.

The front portion 116' has connection points 118' on lateral sides thereof to connect with connection points 111' of the structural panels 110'. The front portion 116' is removably connected to the structural panels 110' via fasteners (not shown). It is contemplated that the front portion 116' could be connected to the structural panels 110' by means other than fasteners. For example, the front portion 116' could be clipped to structural panels 110'.

The front portion 116' has connection points 113' to connect with connection points 119' of the top portion 117'. The front portion 116' is removably connected to the top portion 117' via fasteners. It is contemplated that the front portion 116' could be connected to the top portion 117' by means other than fasteners. For example, the front portion 116' could be clipped to structural panels 110'.

The front cover 130 removably connects to the front portion 116' in a way similar to described above with respect to the cowling 100.

The top portion 117' has connection points 119' to connect with connection points 112' (shown inn FIG. 10) of the structural panels 110'. The connection points 112' are located along a top 75' of the structural panels 110'. The top portion 117' is removably connected to the structural panels 110' via fasteners (not shown). It is contemplated that the front portion 116' could be connected to the structural panels 110' by means other than fasteners. For example, the front portion 116' could be clipped to structural panels 110'.

The top portion 117' has a top aperture 121' for accessing an oil filler neck 91' and a top aperture 123' for accessing the flywheel 94. The top aperture 123' is slightly offset compare to the top aperture 123 because the oil filler neck 91' is slightly offset compared to the oil filler neck 91. It is contemplated that the top apertures 123' could be disposed somewhere else depending on a position of the oil filler neck 91'. It is contemplated that the top portion 117' could have more or less apertures than the top apertures 121', 123', and that the top apertures 121', 123' could be disposed somewhere else on the top portion 117'.

The cap 120 selectively covers the top apertures 121', 123' in a manner similar as the apertures 121, 123 covered by the cap 120 in the cowling 100. The user can perform regular maintenance of the engine 44 through top apertures 121', 123' which provide access to specific parts of the engine 44 (e.g. spark plugs and injectors). Some portion or all of the central support structure 105' may be removed when performing specific operations on the engine 44 when maintenance or repairs cannot be performed using the apertures 114, 121', 123'. To access a specific part of the engine 44, the user proceeds as described above with respect to the cowling 100.

As best shown in FIG. 11, an interior 106' of the top portion 117' houses engine sub-systems 160'. The engine sub-systems 160' are electric systems that are used for the operation of the engine 44. The engine sub-systems 160' are similar to the engine sub-systems 160. It is contemplated that only a portion of the engine sub-systems 160' could be connected to the interior 106' of the top portion 117'. It is also contemplated that some or all of the engine sub-systems 160' could be connected to an interior of one or both of the structural panels 110' or on other panels of the cowling 100'. Among the engine sub-systems 160', an ECU 164' and an electrical wire harness 166' are connected to the interior 106' of the top portion 117'. The electrical wire harness 166' is connected to the top portion 117' by clamps 167'. It is contemplated that the engine sub-systems 160' could have more or less of the engine sub-systems 160' recited above. It is also contemplated that the engine sub-systems 160' could be electronic or mechanical. For example, the engine sub-systems 160' could be an oil reservoir, a water pump, a valve, an induction system, a fuel evaporator separator, an oil pump, or a secondary fuel reservoir. It is also contemplated that connectors other than the clamps 167' could be used to connect the electrical wire harness 166' to the top portion 117'.

Figure 12:
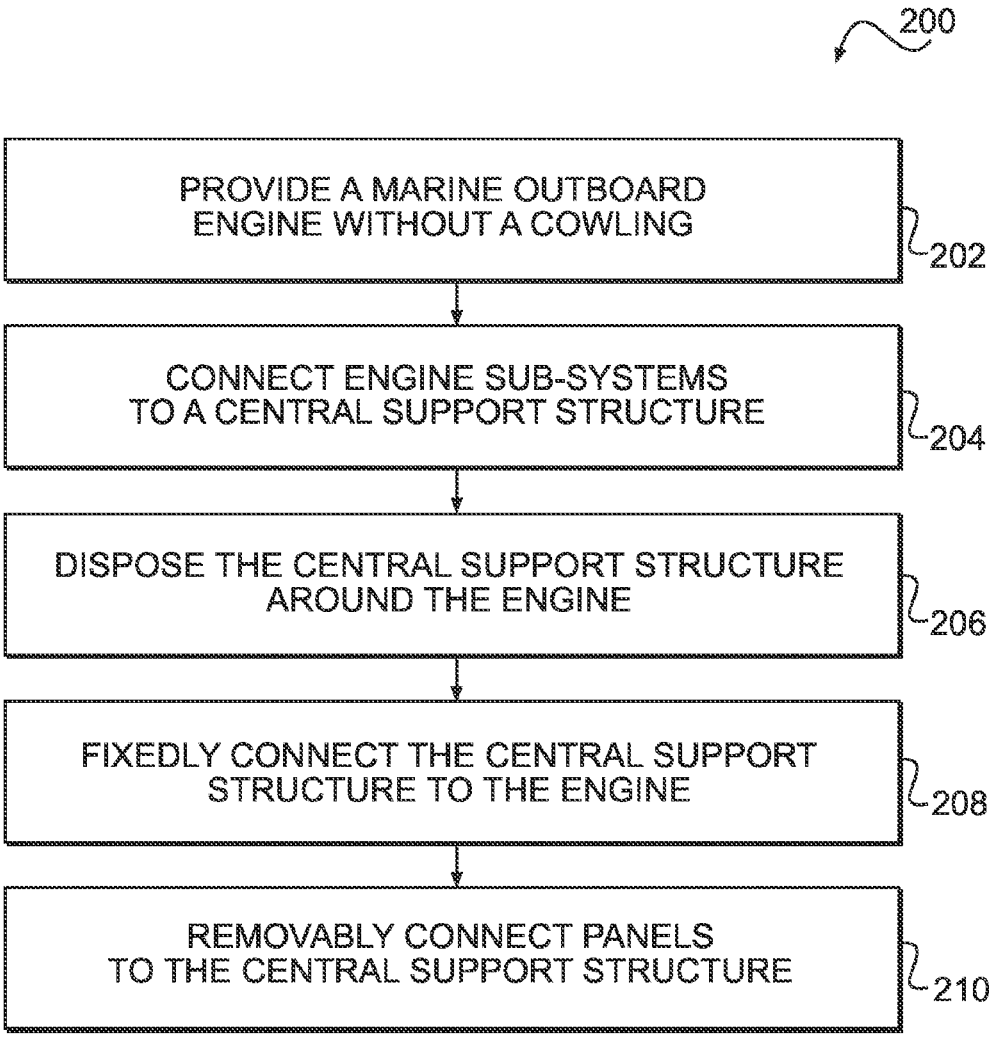
FIG. 12 is a flow chart illustrating a method for assembling the marine outboard engine of FIG. 2.

Referring now to FIG. 12, a method 200 for assembling the marine outboard engine 40 will be described. The method 200 is described using the cowling 100, but it is contemplated that the method 200 could be applied to the cowling 100'.

The method 200 begins at step 202 with providing the marine outboard engine 40 without the cowling 100 (as illustrated in FIG. 3). The marine outboard engine 40 comprises the engine 44, the driveshaft 48, and the exhaust system 46 assembled to each other. It is contemplated that the marine outboard engine 40 could comprise more or less than the engine 44, the driveshaft 48, and the exhaust system 46.

At step 204, the user connects the engine sub-systems 160 to the brackets 158 at the interior 106 of the structural panels 110. This step can be performed while the other components of the marine outboard engine 40 are assembled together.

At step 206, the user surrounds the engine 44 and the driveshaft 48 with the central support structure 105 by disposing the structural panels 110 around them.

At step 208, the user fixedly connects the structural panels 110 using the bolts and the connection points 112 to each other so as to form the central support structure 105. The user connects the central support structure 105 to the engine 44. It is contemplated that the user could connect the central support structure 105 to the swivel bracket 59 or to the exhaust system 46.

At step 210, the user removably connects the panels 120, 130, 140, 150 to the central support structure 105 using the attachments methods described above. It is contemplated that those panels 120, 130, 140, 150 that are hinged to the central support structure 105 could be connected to the central support structure 105 before the central support structure 105 is fixed to the engine 44.

Figure 13:
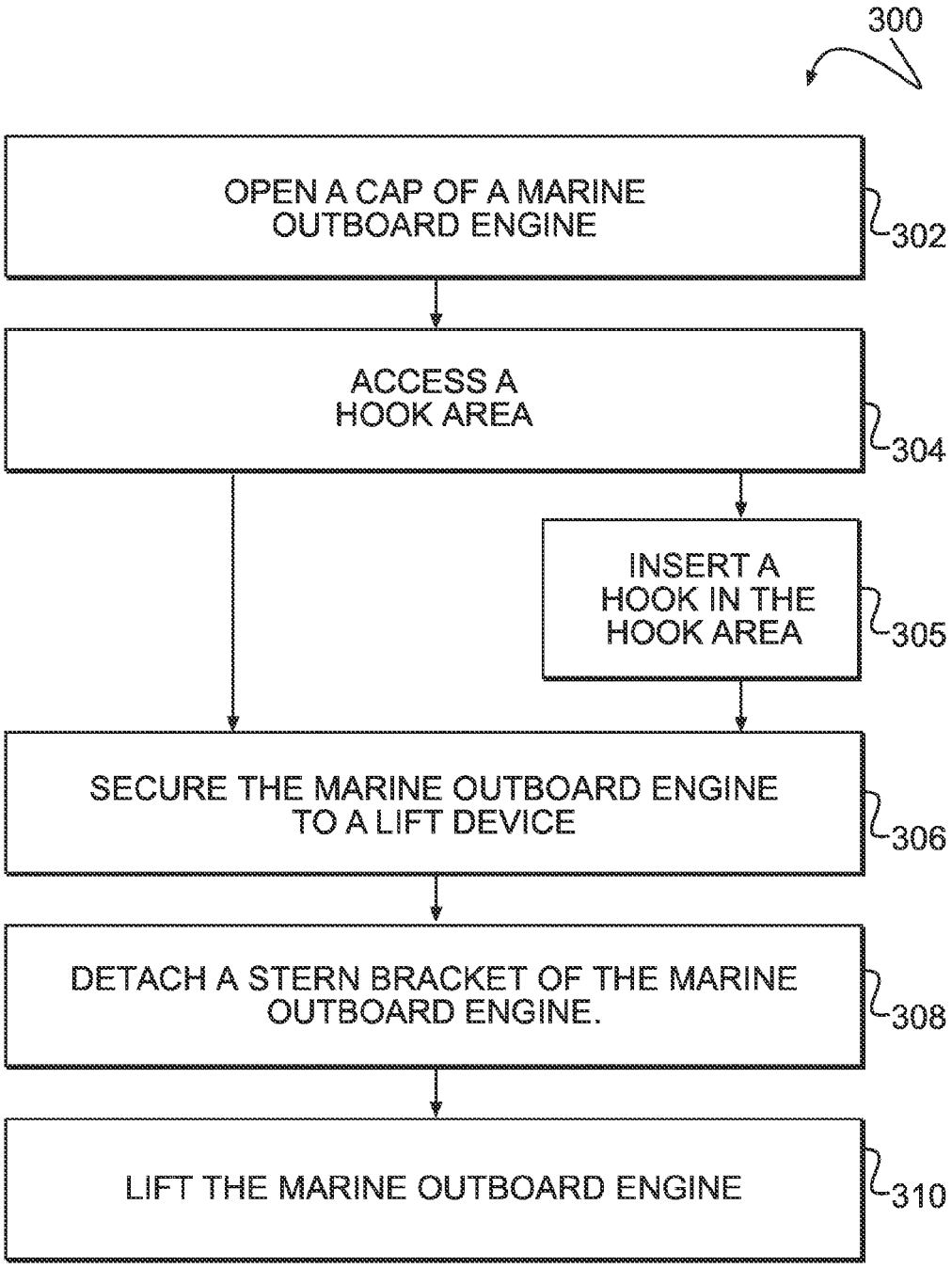
FIG. 13 is a flow chart illustrating a method for removing the marine outboard engine of FIG. 2 from a watercraft.

Referring now to FIG. 13, a method 300 for removing the marine outboard engine 40 from the watercraft will be described. Throughout the method 300, the central support structure 105 is fixed to the engine 44. The method 300 is described using the cowling 100, but it is contemplated that the method 300 could be applied to the cowling 100'.

The method 300 starts with step 302 where the user removes the cap 120 to reveal the top aperture 123 defined in the central support structure 105. It contemplated that the cap 120 could be designed such that the cap 120 itself or a portion thereof is opened in order to reveal the top aperture 123. It is also contemplated that only a portion of the cap 120 could be removed in order to reveal the top aperture 123. It is also contemplated that the cap 120 could just be opened instead of removed, for example when the cap 120 is hinged to the central support structure 105. It is also contemplated that an aperture other than the top aperture 123 could be used.

At step 304, the user accesses the hooking area 127 through the top aperture 123.

At step 305, the user inserts the hook 122 to the hooking area 127 by screwing the hook 122 to the threaded end of the output shaft. It is contemplated that the hook 122 could be already connected to the output shaft so that the user would not need to screw the hook 122 in the threaded aperture prior to securing the marine outboard engine 40 to the lifting device (and hence skip step 305).

At step 306, the user secures the marine outboard engine 40 to a lifting device.

At step 308, the user detaches the stern bracket 58 of the marine outboard engine 40 from the watercraft.

At step 310, the user actuates the lifting device to lift and remove the marine outboard engine 40 from the watercraft.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine comprising:

an engine having a front, back, top and two lateral sides;

one of a propeller and an impeller operatively connected to the engine;

a swivel bracket operatively connected to the engine;

an exhaust system connected to the engine; and a cowling covering at least partially the engine, the cowling including:

a central support structure fixedly connected to at least one of the engine, the swivel bracket, and the exhaust system, the central support structure extending across at least a portion of the front, the top and the back of the engine, the central support structure defining at least partially a space through which at least a portion of at least one of the lateral sides of the engine is accessible; and at least one side panel at least partially selectively connected to the central support structure, the at least one side panel selectively covering the space through which the at least portion of the at least one of the lateral sides of the engine is accessible, the at least one side panel being at least partially disconnectable from the central support structure to reveal the portion of the at least one of the lateral sides of the engine while the central support structure extends across at least the portion of the front, the top and the back of the engine.

2. The marine outboard engine of claim 1, wherein a portion of the central support structure located behind the engine extends vertically below the engine.

3. The marine outboard engine of claim 1, wherein the at least one side panel covers at least a portion of the central support structure.

4. The marine outboard engine of claim 1, wherein the central support structure includes two structural panels fixedly connected to each other along a vertical axis of the marine outboard engine, and each of the two structural panels extending at least partially across the top and a respective one of the lateral sides of the engine.

5. The marine outboard engine of claim 1, wherein the central support structure includes a central structural panel extending at least partially across the top of the engine and two lateral structural panels attached on either side thereof, each lateral structural panel extending at least partially across a respective one of the lateral sides of the engine, at least one of the lateral structural panels defining at least partially the space through which the at least portion of the at least one of the lateral sides of the engine is accessible, the at least one side panel being at least partially selectively connected to a corresponding at least one of the two lateral structural panels defining at least partially the space through which the at least portion of the one of the lateral sides of the engine is accessible.

6. The marine outboard engine of claim 5, wherein the central structural panel comprises a top portion extending generally horizontally across at least a portion of the top of the engine, and a front portion extending generally vertically across at least a portion of the front of the engine.

7. The marine outboard engine of claim 1, wherein the space defined at least partially by the central support structure includes a lateral side aperture of the central support structure disposed on each of the lateral sides of the engine, a portion of each of the lateral sides of the engine being accessible through a corresponding one of the lateral side apertures of the central support structure, the at least one side panel includes two side panels at least partially selectively connected to the central support structure, each of the two side panels selectively covering a respective one of the two lateral side apertures.

8. The marine outboard engine of claim 1, wherein the central support structure is elongated along a vertical axis of the marine outboard engine.

9. The marine outboard engine of claim 1, wherein a portion of the engine protrudes through the space defined at least partially by the central support structure; and as viewed from behind the marine outboard engine, the at least one side panel protrudes outwardly relative to the central support structure.

10. The marine outboard engine of claim 1, further comprising at least one engine sub-system, the at least one engine sub-system being supported by an interior of at least one of the central support structure and the at least one side panel.

11. The marine outboard engine of claim 10, wherein the at least one engine sub-system includes at least one of a fuse box, an ECU, an electrical wire harness and at least one ignition coil.

12. The marine outboard engine of claim 1, wherein the at least one side panel is at least partially selectively connected to the central support structure by at least one of a hinge, a clip and a friction fitted connection to the central support structure.

13. The marine outboard engine of claim 1, further comprising a cap at least partially selectively connected to a top of the central support structure, the cap selectively covering a servicing area of the engine.

14. The marine outboard engine of claim 13, wherein the servicing area provides an access to one of an attachment point of the engine, and a flywheel that is operatively connected to the top of the engine.

15. The marine outboard engine of claim 1, wherein the central support structure includes at least one truss; and the at least one side panel forms an outer surface of the cowling.

16. The marine outboard engine of claim 1, further comprising a driveshaft operatively connected to the engine and to the one of the propeller and the impeller; and wherein:

as viewed from a lateral side of the marine outboard engine with the driveshaft being vertically upright, the cowling extends from a top of the engine to a point vertically below a middle of the swivel bracket, and as viewed from behind the marine outboard engine, at least one of the central support structure and the at least one side panel has a convex contour and the cowling has a generally ovoid shaped contour.

17. The marine outboard engine of claim 1, wherein the at least one side panel extends from at least the top of the engine to at least a lowest point of the swivel bracket.

18. The marine outboard engine of claim 5, further comprising at least one engine sub-system, wherein:

the lateral sides of the engine are left and right lateral side;

the two lateral structural panels are left and right structural panels;

the left structural panel extends at least partially across the left lateral side of the engine;

the right structural panel extends at least partially across the right lateral side of the engine;

the space defined at least partially by the central support structure includes at least one left side aperture in the left structural panel and at least one right side aperture in the right structural panel;

the at least one left and right side apertures are disposed on respective left and right lateral sides of the engine;

a portion of the left and right lateral sides of the engine is accessible through the corresponding at least one left and right side apertures of the central support structure;

the at least one side panel includes at least one left side panel and at least one right side panel;

the at least one left side panel selectively covers the at least one left side aperture;

the at least one right side panel selectively covers the at least one right side aperture; and the at least one engine sub-system is selectively accessible through at least one of the at least one left and right side apertures.

19. A method for assembling a marine outboard engine, the marine outboard engine having an engine and a cowling adapted to at least partially cover the engine, the cowling including a central support structure adapted to extend across at least a portion of a front, a top and a back of the engine, and at least one side panel, the method comprising:

connecting at least one engine sub-system of the engine to an interior of the cowling;

fixedly connecting the central support structure to at least one of the engine, a swivel bracket of the marine outboard engine and an exhaust system of the marine outboard engine; and connecting the at least one side panel over a lateral side aperture defined by the central support structure so as to selectively cover the lateral side aperture, the at least one side panel being at least partially disconnectable so as to at least partially uncover the lateral side aperture while the central support structure extends across at least the portion of the front, the top and the back of the engine.

20. The method of claim 19, wherein:

the step of connecting the at least one engine sub-system of the engine to an interior of the cowling includes connecting the at least one engine sub-system to the central support structure.

* * * * *